US008021127B2

(12) United States Patent
De Larminat

(10) Patent No.: US 8,021,127 B2
(45) Date of Patent: Sep. 20, 2011

(54) SYSTEM AND METHOD FOR COOLING A COMPRESSOR MOTOR

(75) Inventor: Paul De Larminat, Nantes (FR)

(73) Assignee: Johnson Controls Technology Company, Holland, MI (US)

( * ) Notice: Subject to any disclaimer, the term of this patent is extended or adjusted under 35 U.S.C. 154(b) by 925 days.

(21) Appl. No.: 11/679,220

(22) Filed: Feb. 27, 2007

(65) Prior Publication Data

US 2007/0212232 A1 Sep. 13, 2007

Related U.S. Application Data

(63) Continuation-in-part of application No. 10/879,384, filed on Jun. 29, 2004, now Pat. No. 7,181,928.

(60) Provisional application No. 60/871,384, filed on Dec. 22, 2006.

(51) Int. Cl.
*F04B 39/02* (2006.01)
*F04B 39/06* (2006.01)

(52) U.S. Cl. ..... 417/368; 417/371; 417/366; 62/505

(58) Field of Classification Search ..... 417/366, 417/371, 368; 62/505
See application file for complete search history.

(56) References Cited

U.S. PATENT DOCUMENTS

| | | | | |
|---|---|---|---|---|
| 3,088,042 | A * | 4/1963 | Robinson | 417/371 |
| 3,645,112 | A | 2/1972 | Mount et al. | |
| 3,805,547 | A | 4/1974 | Eber | |
| 3,838,581 | A | 10/1974 | Endress | |
| 3,913,346 | A | 10/1975 | Moody, Jr. et al. | |
| 4,182,137 | A | 1/1980 | Erth | |
| 4,216,661 | A | 8/1980 | Tojo et al. | |
| 4,573,324 | A | 3/1986 | Tischer et al. | |
| 4,878,355 | A | 11/1989 | Beckey et al. | |
| 5,350,039 | A | 9/1994 | Voss et al. | |
| 6,009,722 | A | 1/2000 | Choi et al. | |
| 6,032,472 | A | 3/2000 | Heinrichs et al. | |
| 6,065,297 | A | 5/2000 | Tischer et al. | |
| 6,402,485 | B2 * | 6/2002 | Hong et al. | 417/366 |
| 6,450,781 | B1 | 9/2002 | Petrovich et al. | |
| 6,460,371 | B2 | 10/2002 | Kawada | |
| 6,505,480 | B2 | 1/2003 | Tsuboe et al. | |
| 6,579,078 | B2 * | 6/2003 | Hill et al. | 417/423.7 |
| 7,181,928 | B2 | 2/2007 | de Larminat | |
| 2002/0002840 | A1 | 1/2002 | Nakane et al. | |
| 2003/0094007 | A1 | 5/2003 | Choi et al. | |

FOREIGN PATENT DOCUMENTS

| | | | |
|---|---|---|---|
| EP | 1 467 104 | A | 10/2004 |
| GB | 2 117 982 | A | 10/1983 |
| WO | 2004/094833 | A | 11/2004 |

* cited by examiner

*Primary Examiner* — Devon C Kramer
*Assistant Examiner* — Peter J Bertheaud
(74) *Attorney, Agent, or Firm* — McNees Wallace & Nurick LLC

(57) ABSTRACT

Apparatus and methods are provided for cooling motors used to drive gas and air compressors. In particular, the cooling of hermetic and semi-hermetic motors is accomplished by a gas sweep using a gas source located in the low-pressure side of a gas compression circuit. The gas sweep is provided by the creation of a pressure reduction at the compressor inlet sufficient to draw uncompressed gas through a motor housing, across the motor, and out of the housing for return to the suction assembly. The pressure reduction is created by structure in the suction assembly, such as a nozzle and gap assembly, or alternatively a venturi, located upstream of the compressor inlet. Additional motor cooling can be provided by circulating liquid or another cooling fluid through a cooling jacket in the motor housing portion adjacent the motor.

5 Claims, 9 Drawing Sheets

SYSTEM AND METHOD FOR COOLING A COMPRESSOR MOTOR

CROSS-REFERENCE TO RELATED APPLICATIONS

This application is a continuation in part of, and claims priority to, U.S. patent application Ser. No. 10/879,384 having a filing date of Jun. 29, 2004, and which is hereby incorporated by reference. This application further claims the benefit of U.S. Provisional Patent Application 60/871,474, filed Dec. 22, 2006.

FIELD

This application relates to systems and methods for improved cooling of motors used to drive compressors, such as air compressors and compressors used in refrigeration systems. In particular, the application relates to cooling of compressor motors by uncompressed gas passing through the motor housing. The pressure reduction necessary to draw the uncompressed gas through the motor housing is generated by pressure reduction means, such as a nozzle and gap, or alternatively a venturi, provided in the suction assembly to the compression mechanism of the compressor.

BACKGROUND

Gas compression systems are used in a wide variety of applications, including air compression for powering tools, gas compression for storage and transport of gas, and compression of refrigerant gases for refrigeration systems. In each system, motors are provided for driving the compression mechanism to compress the gas. The size and type of motor depends upon several factors such as the type and capacity of the compressor, and the operating environment of the system. Providing adequate motor cooling, without sacrificing energy efficiency of the compression system, continues to challenge designers of gas compression systems.

For example, motor cooling of compressor motors in refrigeration systems, especially large-capacity systems, remains challenging. In a typical refrigeration system, the compressor and the expansion device generally form the boundaries of two parts of the refrigeration circuit commonly referred to as the high-pressure side and the low-pressure side of the circuit. The low-pressure side generally includes biphasic piping connecting the expansion device and the evaporator, the evaporator, and a suction pipe that provides a path for refrigerant gas from the evaporator to the compressor inlet. The high-pressure side generally includes the discharge gas piping connecting the compressor and the condenser, the condenser, and the piping providing a path for liquid refrigerant between the exit of the condenser and the expansion device. In addition to the basic components described above, the refrigeration circuit can also include other components intended to improve the thermodynamic efficiency and performance of the system.

In the case of a multiple-stage compression system, and also with screw compressors, an "economizer" circuit may be included to improve the efficiency of the system and for capacity control. A typical economizer circuit for a multiple stage compression system includes means for drawing gas from a "medium-pressure" part of the compression cycle to reduce the amount of gas compressed in the next compression stage, thus increasing efficiency of the cycle. The medium-pressure gas is typically returned to suction or to an early compression stage.

Centrifugal compressors are often used for refrigeration systems, especially in systems of relatively large capacity. Centrifugal compressors often have pre-rotation vanes at their suction inlets that are used to vary the flow of refrigerant gases entering the compressor inlet. Centrifugal compressors are usually driven by electric motors that are often included in an outer hermetic housing that encases the motor and compressor. While this configuration reduces the risk of refrigerant leaks, it does not permit direct cooling of the motor using ambient air. The motor must therefore be cooled using a cooling medium, typically the refrigerant used in the main refrigerant cycle.

Many modes have been proposed and implemented to circulate refrigerant to cool compressor motors. For example, refrigerant can be sent in gas or liquid phase to the active parts of the motor and to the motor housing. In such cases, the refrigerant is necessarily supplied through orifices or passageways provided in the motor housing. After cooling the motor, refrigerant gas is typically sent to the compressor suction, either through paths internal to the compressor or through external pipes.

In some known motor cooling methods using liquid refrigerant, the refrigerant is sourced from the high-pressure liquid line between the condenser and the expansion device. The liquid is injected into the motor housing where it absorbs motor heat and rapidly evaporates or "flashes" into gaseous form, thus cooling the motor. The resulting refrigerant gas is then sent typically to the compressor suction through channels provided in the motor housing and/or in the motor itself. The benefit of liquid injection cooling is that there exists a great variety of potential injection points in a typical motor assembly. Other advantages of direct liquid cooling include the flow of liquid refrigerant over and around hard to reach areas such as the rotor and stator assemblies, thereby establishing direct contact heat exchange. Such direct contact heat exchange has been found to be a highly desirable method of cooling the motor in general, and particularly the rotor assembly and motor gap areas of the motor. Unfortunately, the high velocity liquid refrigerant sprays produced by known direct liquid refrigerant injection techniques represent a potentially dangerous source of erosion to exposed motor parts such as the exposed end coils of the stator winding. To avoid this problem, some manufacturers incorporate enclosed stator chambers to provide for motor cooling by indirect heat exchange. In such assemblies, a sealed chamber or jacket is provided around the outer periphery of the stator, and low-velocity liquid refrigerant is circulated through the chamber to provide indirect heat exchange to the stator assembly. Such systems avoid the potential erosion problems of direct liquid refrigerant injection, but are not very effective in cooling other motor areas such as the air gap, rotor area, and the motor windings.

To avoid the risks of liquid refrigerant injection for motor cooling, it is also possible to use refrigerant gas. On small capacity refrigeration systems having small displacement compressors, the most common gas motor cooling method is to circulate all or most of the gaseous refrigerant to be handled by the compressor through the motor housing. Some gaseous refrigerant can also be taken at high pressure, or at medium pressure in the case of a multiple stage compressor. Refrigerant gas can be channeled into the motor and motor housing at various locations, and can be circulated using various modes. For example, one technique is directed to a way to circulate some cold gas from the evaporator transverse to the motor axis to cool the windings area. In contrast, another technique is directed to a way to circulate some high-pressure gas internally from the second stage impeller into the motor housing before it is released into the discharge pipe. The resulting gas circulation in the motor is axial in the provided air gap, stator notches, and passages around the stator.

A significant drawback of the above gas-phase motor cooling systems and methods is that usually, virtually the entire refrigerant gas flow is circulated through the motor and motor housing. There is much more refrigerant gas flowing through the motor than what is needed for cooling, and the gas flow through the motor generates substantial pressure drops that reduce the system efficiency. While such pressure drops and resulting inefficiencies may be acceptable for small capacity refrigerant systems, they are not acceptable or suitable for large capacity compressors. Accordingly, those systems are used in reciprocating compressors and small screw or scroll compressors, but not for large centrifugal compressors. For large capacity refrigeration systems, such as those used to cool office buildings, large transport vehicles and vessels, and the like, it is desirable to send only a limited amount of refrigerant to cool specific points of the motor and motor housing.

Another problem is the sourcing of the coldest available refrigerant gas through the motor housing to ensure adequate cooling. For example, it is possible to draw gas from the high-pressure side of the refrigeration circuit for cooling, and return it to the compressor suction. However, a relatively high gas flow is required because the relatively high gas temperature cannot provide efficient cooling of the motor. Also, the sourced gas must be re-compressed without providing any cooling effect in the cycle. Thus, the high-pressure side is a poor motor coolant source because of its severe effects on system efficiency.

Alternatively, it is possible to cool the motor using medium-pressure gas from an economizer cycle. Where an economizer is provided, medium-pressure gas can be sourced from a compression stage of the motor and returned to a lower compression stage or possibly to compressor suction. Sourcing and circulation of such medium-pressure gas is simple because of the substantial pressure difference available between medium and low pressures in the economizer and low-pressure side, respectively. While the problem of marginal motor cooling due to elevated gas temperature is still encountered, the required volume of gas flow is lower because of the lower relative gas temperature. Medium-pressure cooling systems have been implemented with limited success. In the medium-pressure gas cooling systems, the gas circulated through the motor housing is at medium pressure, resulting in higher gas friction than if the gas were taken at low pressure, further limiting the cooling effect on the motor.

In light of the foregoing, there is a continuing need for an efficient system and method for motor cooling in gas compression systems using the circulated fluid without adversely affecting system capacity or significantly reducing system efficiency.

SUMMARY

The present application overcomes the problems of the prior art by providing a system and method for the cooling of motors driving gas compressors by diverting part of the uncompressed gas flow into the motor housing prior to compression of the gas. In the specific case of a refrigerant circuit, the uncompressed refrigerant gas is taken from the low-pressure side of a refrigeration circuit. The application also provides for additional motor cooling using liquid cooling means and methods in combination with uncompressed refrigerant gas sweep means and methods.

In one embodiment, a gas compression system includes: a compressor having a compressing mechanism; a suction assembly for receiving uncompressed gas from a gas source and conveying the uncompressed gas to the compressor, the suction assembly comprising: a suction pipe in fluid communication with the gas source; means for creating a pressure reduction in the uncompressed gas from the gas source, the means for creating a pressure reduction being in fluid communication with the suction pipe; and a compressor inlet disposed adjacent to the means for creating a pressure reduction, the compressor inlet being configured to receive uncompressed gas from the means for creating a pressure reduction and to provide the uncompressed gas to the compressing mechanism; a motor connected to the compressor to drive the compressing mechanism; and, a housing enclosing the compressor and the motor, the housing comprising at least one inlet opening in fluid communication with the gas source and at least one outlet opening in fluid communication with the means for creating a pressure reduction, wherein the means for creating a pressure reduction draws uncompressed gas from the gas source through the housing to cool the motor and returns the uncompressed gas to the suction assembly.

In one embodiment for centrifugal compressors, the means for creating pressure reduction includes a converging nozzle portion configured to accelerate flow of uncompressed refrigerant gas through the nozzle portion, a gap disposed adjacent to the outlet of the converging nozzle portion, and a compressor impeller inlet adjacent the gap. In this embodiment, the system further has a motor for driving the compressing mechanism, the motor and compressing mechanism being enclosed within a housing, the housing including at least one inlet opening communicably connected to a refrigerant gas source upstream of the compressor. The housing further including at least one gas return opening communicably connected to the gap in the suction connection, wherein the converging nozzle portion creates a pressure differential at the gap sufficient to draw refrigerant gas from the refrigerant gas source upstream of the compressor into the at least one opening, through the housing, out of the gas return opening and into the gap, thereby cooling the motor.

In another embodiment not specific to centrifugal compressors, the means for creating a pressure reduction is a venturi.

Yet another embodiment is directed to a refrigeration system having a compressor, a condenser, and an evaporator connected in a closed refrigerant circuit, and having the features of the embodiments described above.

The application further provides methods of cooling a motor in a gas compression system having a motor-driven compressor. The methods include the steps of: providing a gas compression system, the system having a suction assembly having means for creating a pressure differential in a flow of uncompressed gas, a compressor including a compressor inlet for receiving uncompressed gas from the suction assembly and conveying the gas to a compression mechanism, a motor for driving the compressing mechanism, the motor and compressor mechanism disposed within a housing, the housing including at least one inlet opening communicably connected to a gas source upstream of the compressor, the housing further including at least one outlet opening communicably connected to the means for creating a pressure differential in the suction assembly; operating the compressor to draw and accelerate a flow of uncompressed gas through the means for creating a pressure differential and into the compressor inlet; creating a pressure differential in the flow of uncompressed gas sufficient to draw uncompressed gas from the gas source through the inlet opening and into the housing; circulating the uncompressed gas in the motor housing to cool the motor; and drawing the circulated uncompressed gas from the housing through the at least one outlet opening for return to the suction assembly.

One advantage includes improvement in motor cooling in large capacity refrigeration systems without unacceptable compromises to system efficiency. Another advantage is excellent motor cooling through the combination of refrigerant gas circulation through the motor housing that can be further improved with circulation of liquid coolant through jackets or chambers located adjacent to targeted areas of the motor.

Other features and advantages of the present invention will be apparent from the following more detailed description, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION

Figure 1:
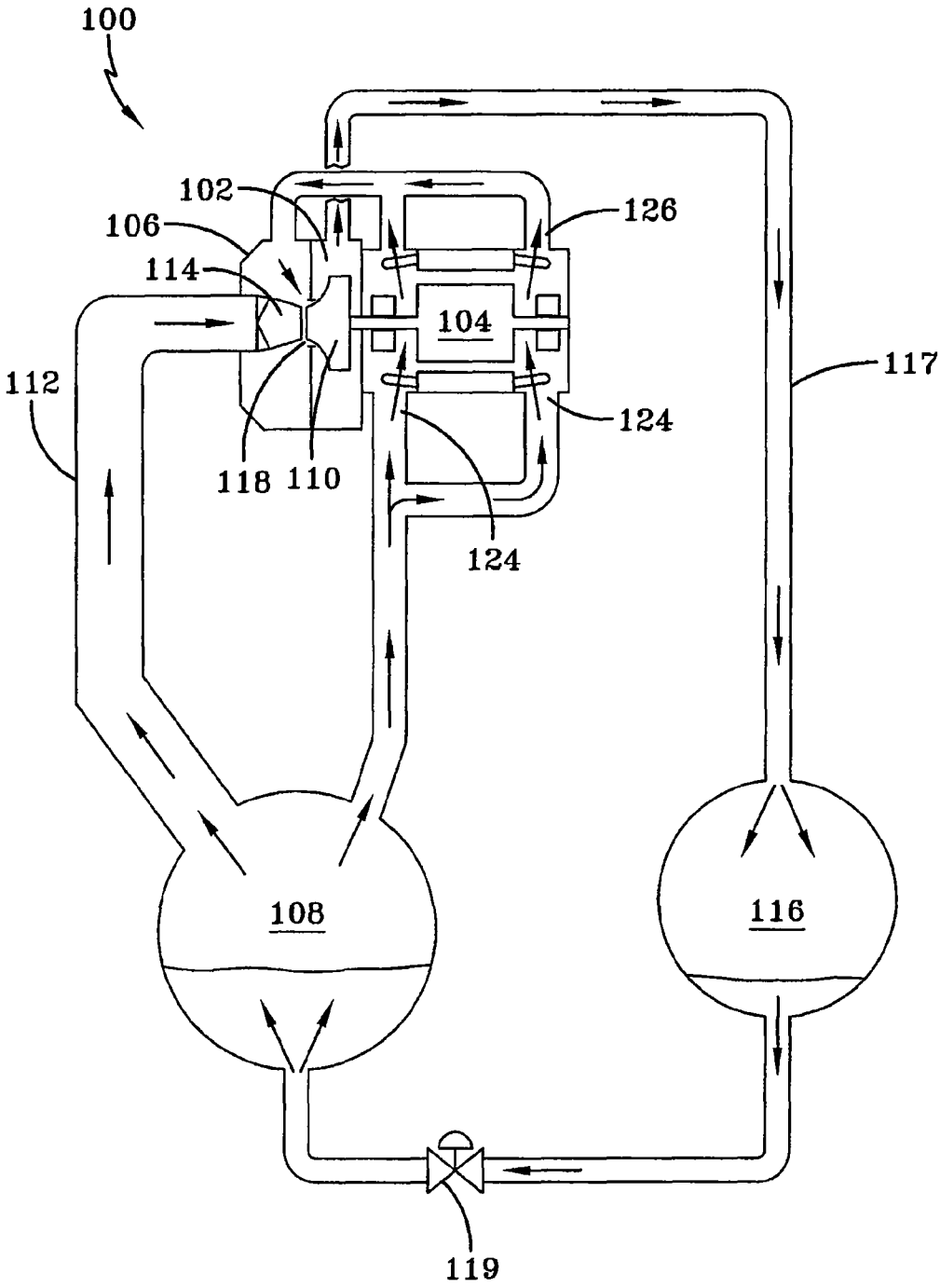
FIG. 1 illustrates schematically an embodiment of the motor cooling system as applied to a refrigeration system using a single stage centrifugal compressor.

The application provides optimized cooling of hermetic motors using low-pressure gas, such as uncompressed gas. The application provides motor cooling by a gas sweep, with the gas source located in the low-pressure side of the compression circuit. In a refrigeration circuit application, the uncompressed refrigerant gas is sourced from the evaporator, for example, and is drawn into the motor housing, through or around the motor (or both), by a pressure reduction created at the suction inlet to the compressor. Alternatively, the refrigerant gas source is the suction pipe or a suction liquid trap.

The application can provide for additional motor cooling by circulation of liquid coolant through a motor cooling jacket or through chambers provided in the motor housing. In refrigeration system embodiments, the circulating liquid can be liquid refrigerant, which liquid refrigerant can be injected directly into the motor housing, and any combination of these features can supplement the cold gas sweep of the motor using gas from the low-pressure side of the refrigeration circuit.

The application is applicable to gas compression systems of all types. For ease of illustration and explanation, FIGS. 1-6 illustrate the environment of a refrigeration system. However, that environment is exemplary, and is non-limiting.

A general refrigeration system incorporating the apparatus of the present invention is illustrated, by means of example, in FIGS. 1-4. As shown, refrigeration system 100 includes a compressor 102, a motor 104, the compressor 102 and motor 104 encased in a common housing 106, an evaporator 108, and a condenser 116. The motor housing 106 includes a motor housing portion 106*a* and a compressor housing portion 106*b*. The conventional refrigeration system 100 includes many other features that are not shown in FIGS. 1-4. These features have been purposely omitted to simplify the drawings for ease of illustration.

The compressor 102 compresses a refrigerant vapor and delivers the vapor to the condenser 116 through a discharge line 117. In one example, the compressor 102 is a centrifugal compressor. To drive the compressor 102, the system 100 includes a motor or drive mechanism 104 for compressor 102. While the term "motor" is used with respect to the drive mechanism for the compressor 102, it is to be understood that the term "motor" is not limited to a motor but is intended to encompass any component that can be used in conjunction with the driving of motor 104, such as a variable speed drive and a motor starter, or a high speed synchronous permanent magnet motor, for example. In an exemplary embodiment, the motor 104 is an electric motor and associated components.

The refrigerant vapor delivered by the compressor 108 to the condenser 116 through the discharge line 117 enters into a heat exchange relationship with a fluid, e.g., air or water, and undergoes a phase change to a refrigerant liquid as a result of the heat exchange relationship with the fluid. The condensed liquid refrigerant from condenser 116 flows through an expansion device 119 to an evaporator 108. In one embodiment, the refrigerant vapor in the condenser 116 enters into the heat exchange relationship with fluid flowing through a heat-exchanger coil (not shown). In any event, the refrigerant vapor in the condenser 116 undergoes a phase change to a refrigerant liquid as a result of the heat exchange relationship with the fluid.

Figure 3:
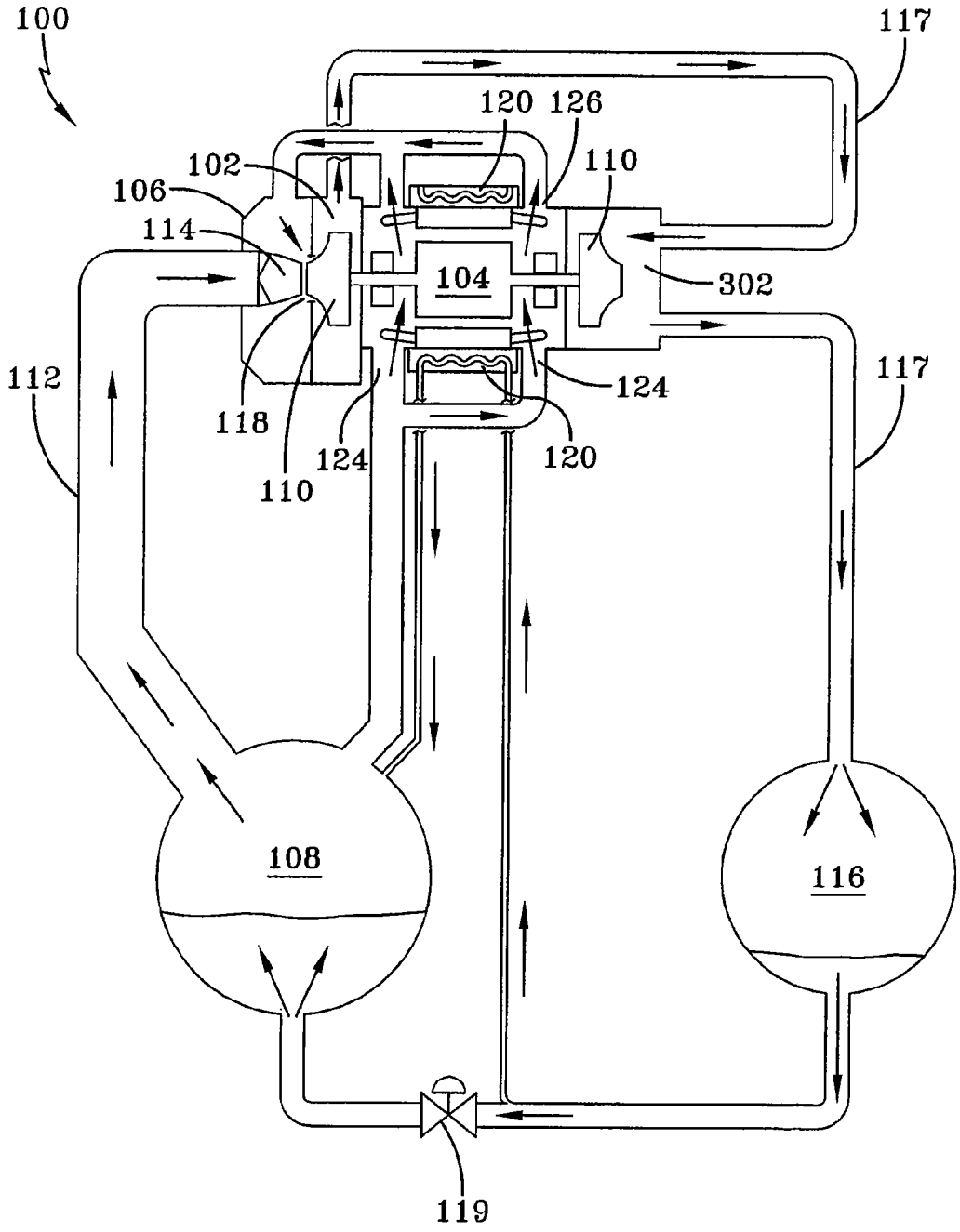
FIG. 3 illustrates schematically an embodiment of a motor cooling system as applied to a refrigeration system using a two-stage centrifugal compressor.

The evaporator 108 can be of any known type. For example, the evaporator 108 may include a heat-exchanger coil having a supply line and a return line connected to a cooling load. The heat-exchanger coil can include a plurality of tube bundles within the evaporator 108. A secondary liquid, which may be water, but can be any other suitable secondary liquid, e.g., ethylene, calcium chloride brine or sodium chloride brine, travels in the heat-exchanger coil into the evaporator 108 via a return line and exits the evaporator via a supply line. The refrigerant liquid in the evaporator 108 enters into a heat exchange relationship with the secondary liquid in the heat-exchanger coil to chill the temperature of the secondary liquid in the heat-exchanger coil. The refrigerant liquid in the evaporator 108 undergoes a phase change to a refrigerant vapor as a result of the heat exchange relationship with the secondary liquid in the heat-exchanger coil. The low-pressure gas refrigerant in the evaporator 108 exits the evaporator 108 and returns to the compressor 102 by a suction pipe 112 to complete the cycle. Alternatively, as shown in FIG. 1 and FIG. 3, at least a portion of the refrigeration in evaporator 108 is returned to the motor housing 106 by a dedicated connection between motor housing 106 and evaporator 108.

While the system 100 has been described in terms of particular embodiments for the condenser 116 and evaporator 108, it is to be understood that any suitable configuration of condenser 116 and evaporator 108 can be used in the system 100, provided that the appropriate phase change of the refrigerant in the condenser 116 and evaporator 108 is obtained.

FIG. 1 schematically illustrates one embodiment of a refrigeration circuit 100 having a centrifugal compressor 102. However, the motor cooling apparatus and methods can be used whether installed in a refrigeration circuit or other gas compression systems, including air compressors.

As shown in FIGS. 1-6, motor cooling in accordance with the present invention is provided by creating a pressure reduction sufficient to draw uncompressed gas from the low-pressure side of the compression circuit through the motor 104 and motor housing 106 before returning it to the suction gas stream, for example substantially adjacent the compressor inlet 502 of the compressor 102.

In the specific embodiment of FIG. 1 involving a motor 104 driving a centrifugal compressor 102, the pressure reduction necessary to draw refrigerant gas from the low-pressure gas source, shown here as the evaporator 108, is generated using low static pressure generated at the compressor inlet 502, here the inlet eye of the impeller 110. The suction stream of gas to be compressed flows through a suction pipe 112 to a converging nozzle 114, wherein the flow velocity of the gas is significantly increased. At least one annular passageway(s) or gap(s) 118 is provided between the outlet 500 of the nozzle 114 and the inlet eye of the impeller 110. Additionally, pre-rotation vanes can be included to control the flow of uncompressed gas into the compression mechanism of the compressor 102. As a result of the high velocity suction gas flow, the static pressure at the annular gap 118 provided between the nozzle 114 and the inlet eye is substantially lower than in the rest of the low-pressure side of the circuit, including the evaporator 108 and the upstream suction pipe 112. The apparatus of the invention utilizes the low pressure generated at the inlet eye of the impeller 110 to draw gas from the evaporator 108 and through the motor 104 and/or motor housing portion 106*a*.

The motor housing 106*a* has an outer casing having at least one inlet opening 124 adapted for communicable connection to or in fluid communication with the evaporator 108 or other source of uncompressed gas, and at least one outlet opening 126 provided in the compressor housing 106 adapted for communicable connection to or in fluid communication with means for creating a pressure reduction in the suction assembly. Here, the means for pressure reduction is shown as a converging nozzle 114 adjacent the inlet eye of the impeller 110, and includes an annular gap provided between the converging nozzle and the impeller inlet. The annular gap is in fluid communication with the motor housing outlet opening 126. For example, the openings 124, 126 are located and disposed in the outer casing of the motor housing portion 106*a* such that gas drawn through the evaporator connection flows through each inlet opening 124, across at least a portion of the motor 104, and exits the motor housing portion 106*a* through at least one outlet opening 126 before returning to the suction pipe 112. In the embodiment of FIG. 1, due to the pressure reduction generated at the annular gap 118 by the high velocity suction gas flow created by a converging nozzle 114 in the suction pipe 112, gas from the evaporator 108 is drawn through the inlet opening 124, through the motor housing portion 106*b*, through the outlet 126, and into the annular gap 118 where it mixes with the main suction gas stream before being drawn into the compressor inlet 502 and reaching the compression mechanism of the compressor 102. Although the connections between the gas outlet 126 and the means for creating pressure reduction in FIGS. 1-4 and 5 are shown as external piping, the connection can be a communicable connection internal to the compressor housing 106 without departing from the application.

Figure 2:
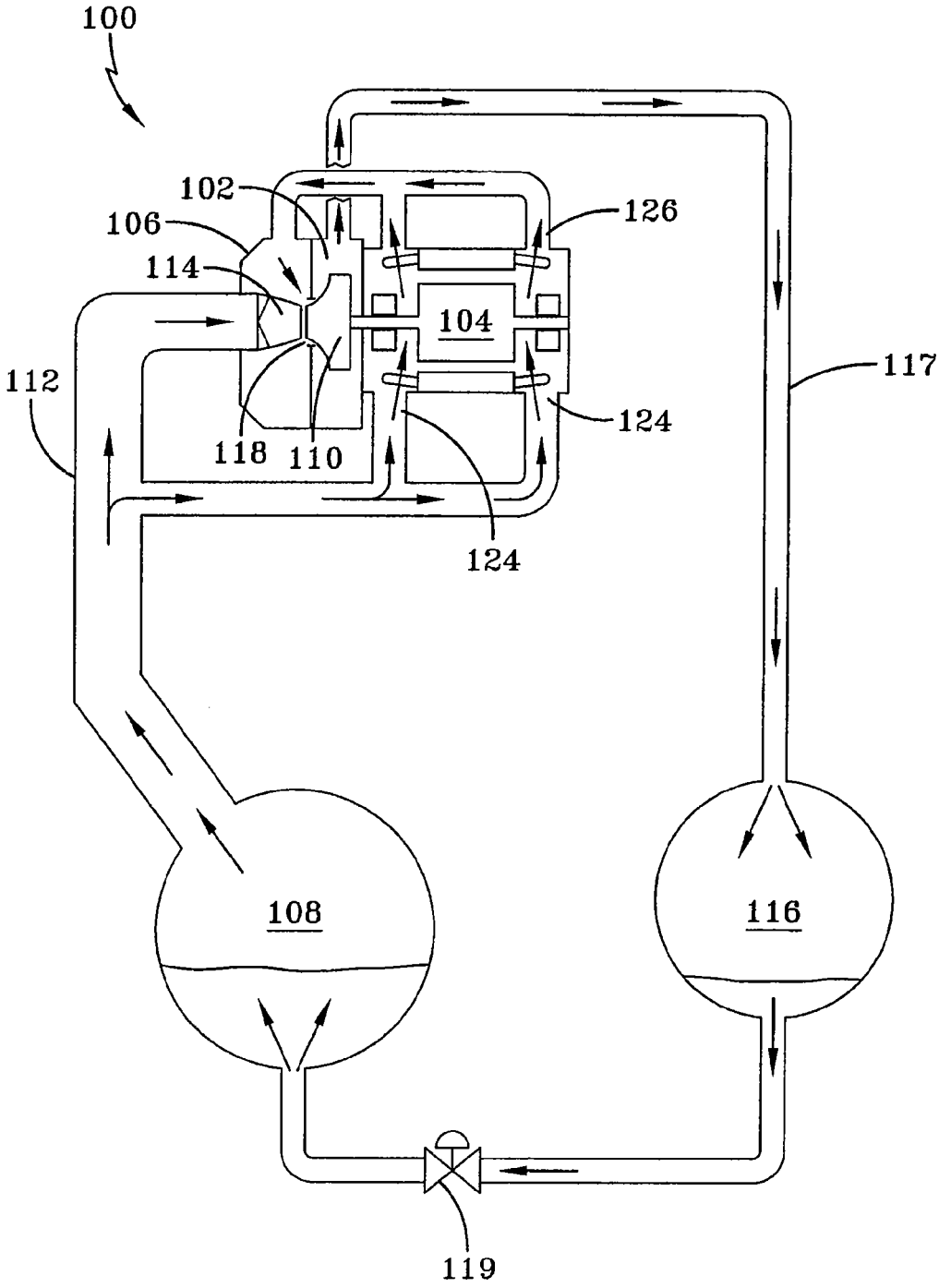
FIG. 2 illustrates schematically another embodiment of the motor cooling system as applied to a refrigeration system using a single stage centrifugal compressor.
Figure 4:
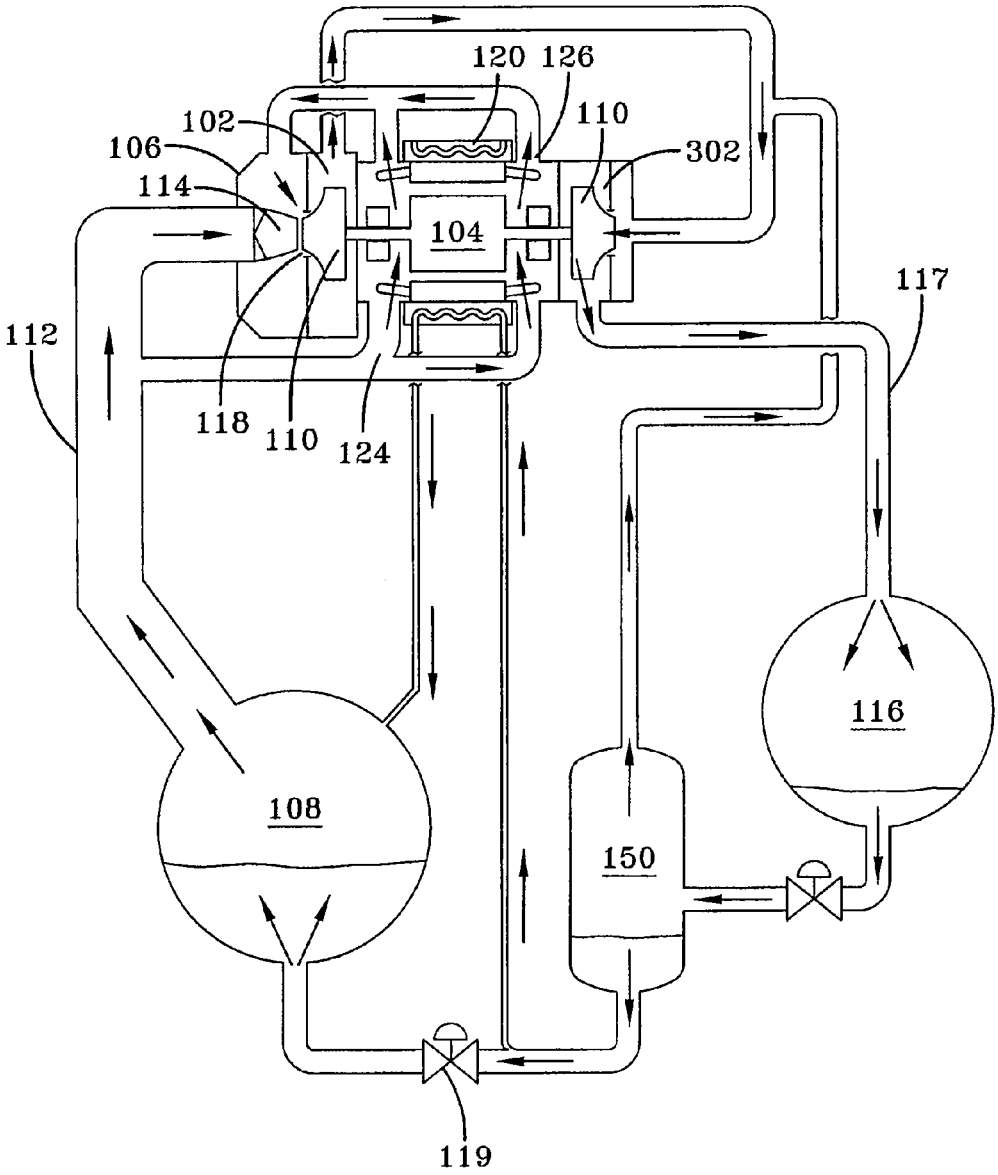
FIG. 4 illustrates schematically another embodiment of a motor cooling system as applied to a refrigeration system using a two-stage centrifugal compressor, the system including an economizer circuit.

In the embodiment of FIG. 2, the refrigeration system varies from the embodiment of FIG. 1 in that low-pressure refrigerant gas is sourced from the suction pipe 112, rather than from the evaporator 108. In the embodiment of FIG. 3, uncompressed gas is sourced from the evaporator 108. In the embodiment of FIG. 4 the cooling gas is sourced from the suction pipe 112. Additionally, in both FIGS. 3 and 4, the compressor 102 is shown as a two-stage compressor having a second stage 302. In those embodiments, as shown in FIG. 4, an economizer circuit 150, can be incorporated to increase efficiency and to increase compressor cooling capacity. Friction heat in the air gap, as well as rotor heat, can be removed by any of the above combinations, or by any other combination of the disclosed gas sweep and liquid cooling methods.

To complement the cooling of at least some parts of the motor 104 by uncompressed gas sweep from the low-pressure side of a compression circuit as described above, additional cooling of the motor 104 may be provided by other processes. For example, in refrigeration systems, injection of liquid refrigerant into an annular chamber provided in the motor housing 106 surrounding the motor stator can be utilized to provide stator cooling. Additional chambers may be provided in the motor housing portion 106*a* to cool other targeted areas of the motor 104. Alternatively, an enclosed jacket 120 may be provided surrounding (or adjacent to) the motor 104. Circulation of liquid refrigerant or other cooling liquids, such as water, propylene glycol, and other known coolant liquids through the jacket 120 or chambers internal to the motor housing portion 106*b* cools targeted portions of the motor 104. For example, the outer part of the stator of the motor may be surrounded by a jacket 120, as shown in FIGS. 3-4. In those embodiments, a jacket 120 is provided to remove the heat from the stator, and circulating refrigerant gas is used to cool the bearings and motor windings. The motor and/or bearings may optionally incorporate magnetic bearings and associated magnetic technology. Additionally or alternatively, if other cooling liquids are used, the cooling liquid can be contained in a cooling piping loop that is separate from refrigerant circuit.

As shown in FIGS. 3-4, where liquid refrigerant is used as the cooling fluid, rather than adjusting the flow of liquid refrigerant through the jacket 120 to ensure complete evaporation, it is desirable to inject an excess of liquid refrigerant from the condenser 116 into the motor housing 106. After cooling the motor 104, the resulting two-phase mixture of evaporated gas and excess liquid refrigerant is then sent to the evaporator 108, and not into the compressor suction 112. Sending the excess liquid to the evaporator is especially suitable if the evaporator 108 is of the flooded type, where the shell of the evaporator 108 provides the function of liquid separation. With some other evaporator types, it may be necessary to send the liquid to a suction trap.

Figure 5:
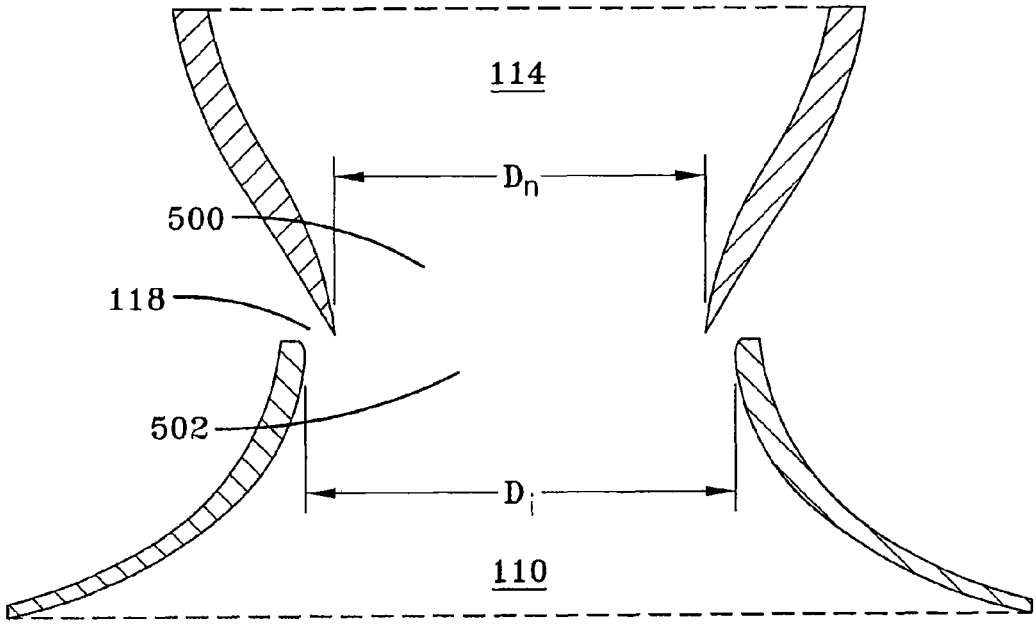
FIG. 5 illustrates a close-up view of the converging nozzle and annular gap of the motor cooling system of FIGS. 1-4.

As illustrated in FIG. 5, the shapes and relative dimensions of the nozzle 114, nozzle outlet 500, the annular gap 118, and the compressor inlet 502 allows a smooth merging of the motor cooling gas coming through the gap 118 into the main suction gas stream. Accordingly, the annular gap 118 allows clean stream flow of the cooling gas from the nozzle 114 to the compressor inlet 502. In the particular embodiment of FIG. 5, the nozzle 114 has a converging profile leading to a nozzle outlet 500 adjacent the gap 118. For example, the diameter $D_n$ of the nozzle outlet 500 may be smaller than the diameter $D_i$ of the compressor inlet 502 leading to the compression mechanism, such as the impeller 110. Depending on the amount of uncompressed gas required to cool the motor, the diameter $D_i$ can be between about 1% and 15% larger, or in another example is between about 2% to about 5% larger than $D_n$. Optionally, the wall of the nozzle outlet 500 may be tapered as shown in FIG. 5, and the wall of the compressor inlet 502 to the compressor 102 may include a flange or other widening structure so as to effectively channel intake of suction gas across the gap and into the compressor inlet 502 to create the pressure differential necessary to draw cooling gas from the evaporator 108 though the housing 106.

Figure 6:
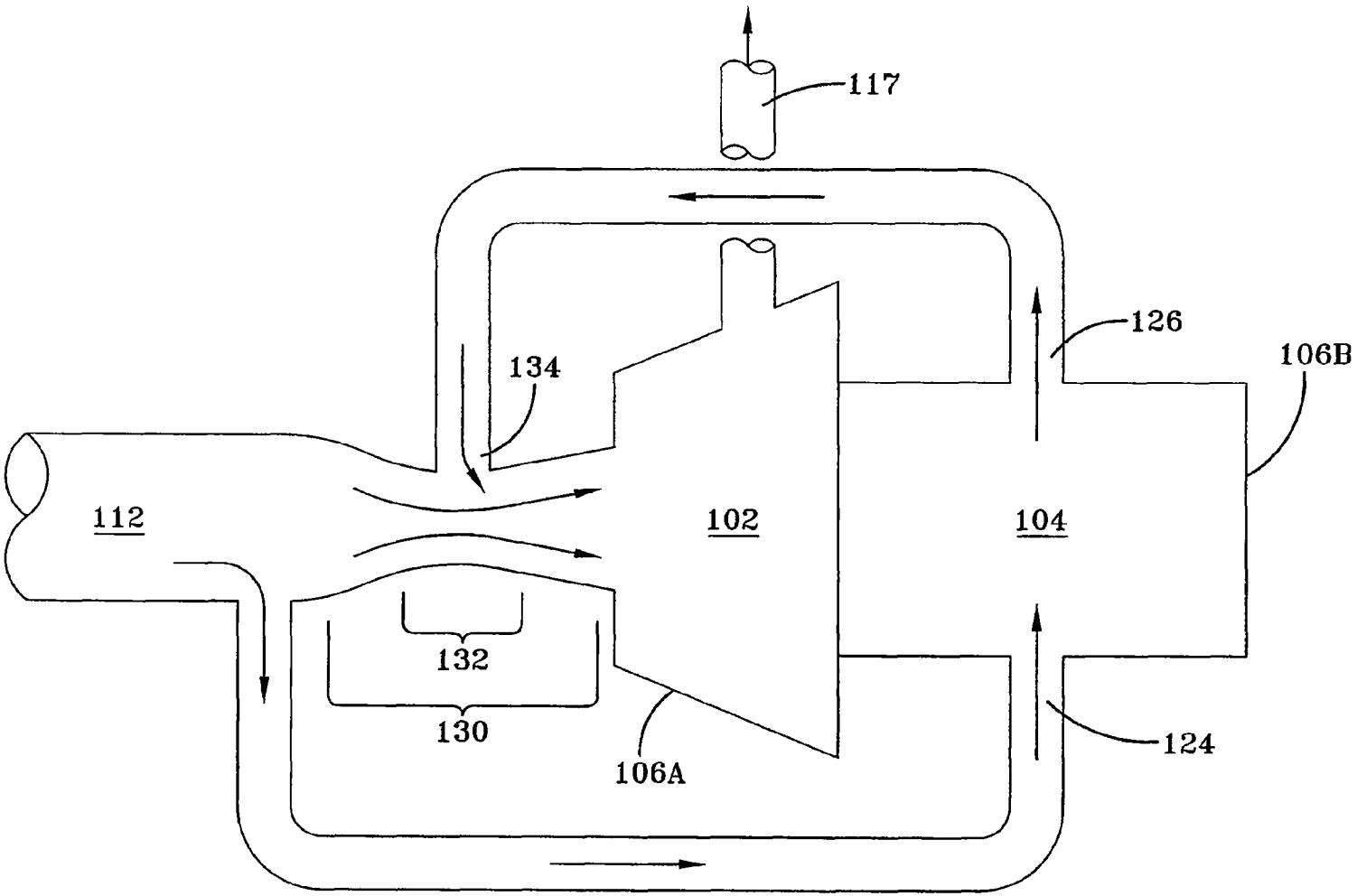
FIG. 6 illustrates schematically an embodiment of the motor cooling system as can be implemented for a non-centrifugal compressor.

FIG. 6 illustrates schematically an embodiment of a gas compression system for a non-centrifugal compressor. In this embodiment, a venturi 130 is provided in the suction pipe 112 as a means for creating a pressure reduction sufficient to draw uncompressed gas from the suction pipe 112 through the motor housing portion 106*b* to cool the motor 104. A venturi is a known means for creating a low pressure zone in a fluid flow with a limited pressure drop. The flow is first accelerated through a converging nozzle to generate a pressure reduction, then the velocity is reduced through a diverging nozzle, thereby recovering the kinetic energy of the fluid in the reduced section in order to minimize the pressure drop of the assembly.

In the embodiment of FIG. 6, as gas flows from the suction pipe 112 and enters the narrow portion 132 of the venturi 130, the gas pressure drops to a pressure lower than that of the upstream suction pipe 112. As shown in FIG. 6, the gas inlet 124 is communicably connected to the upstream suction pipe 112, and a gas return 134 provided in the narrow portion 132 is communicably connected to the gas outlet 126 of the motor housing portion 106*b*. As a result of the pressure reduction created in the narrow portion 132 of the venturi 130 as gas flows through the suction pipe 112 and into the venturi 130, higher-pressure gas is drawn from the suction pipe 112 into the motor housing inlet 124, through the motor housing portion 106*b*, out of the motor housing gas outlet 126, and into the venturi gas return 134. In one embodiment, the venturi gas return 134 can include a hole in the wall of the narrow portion 132 of the venturi. Because this particular embodiment utilizes a venturi 130 in the suction pipe 112, it eliminates the need for the specific geometrical features provided at the gas intake of a centrifugal compressor, and therefore can be easily utilized in systems having a wide variety of compressor types, such as reciprocating, scroll, and screw compressors.

Figure 7:
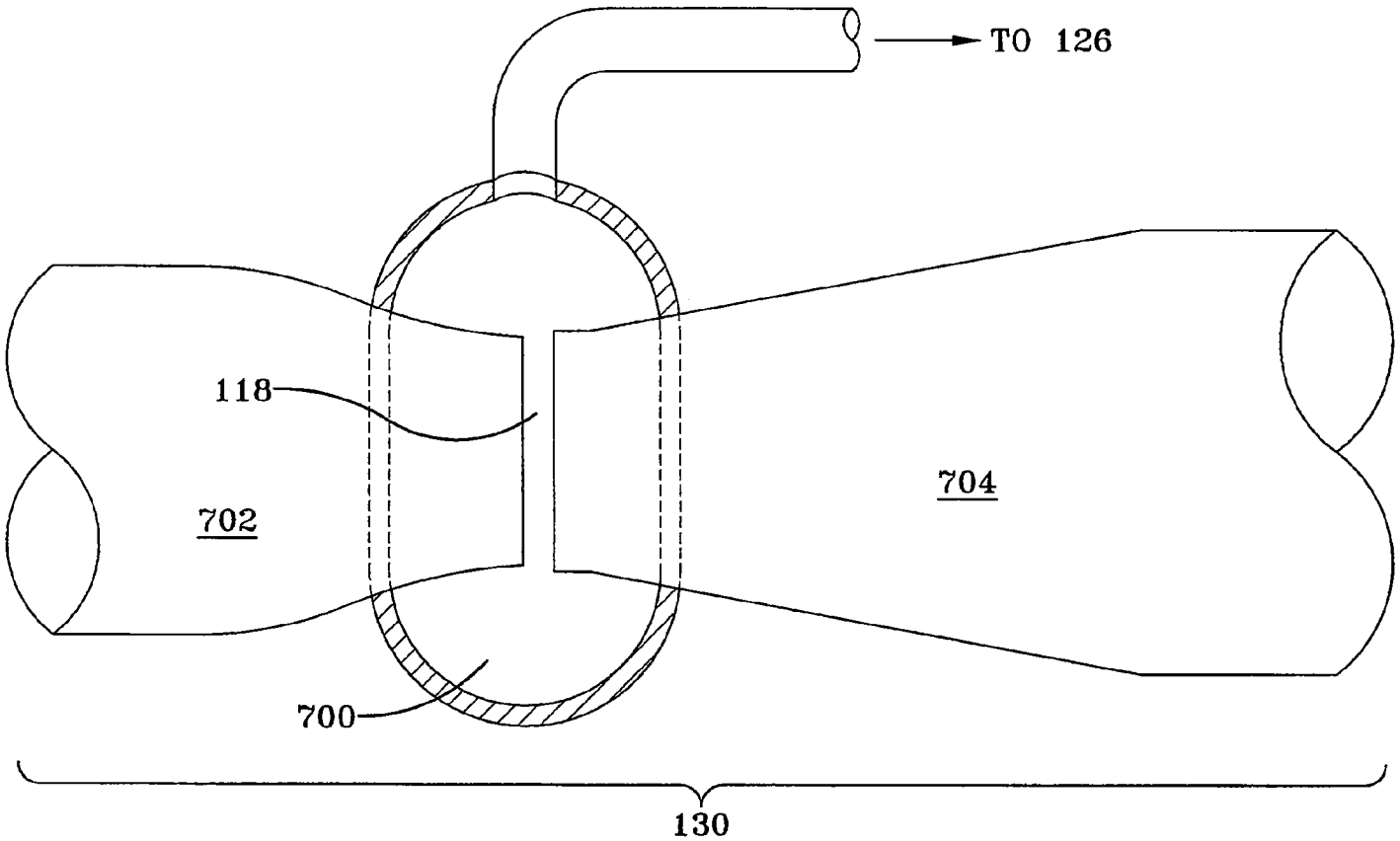
FIG. 7 is a close-up view of the venturi in the motor cooling system of FIG. 6, showing the addition of an annular gap and gas distribution chamber surrounding the annular gap.

FIG. 7 illustrates a particular embodiment of a venturi assembly. In this particular embodiment, an annular gap is provided between the converging nozzle portion 702 and diverging nozzle portion 704 of the venturi 130, allowing the gas to enter all around the reduced section and to merge more smoothly with the main gas stream. As shown, the annular gap 118 may be surrounded by a chamber 700 that acts to collect the gas from the motor housing outlet 126 and channel it into the annular gap 118. The chamber 700 may be substantially annular. More desirably, the diameter of the gap 118 adjacent the diverging nozzle portion 704 is slightly larger than the diameter of the gap 118 adjacent the converging nozzle portion 702 in order effectively draw gas into the diverging portion through the gap 118, and to better accommodate the larger gas flow downstream.

The application further provides a motor housing for use in a gas compression system. The motor housing 106 includes an outer casing for hermetically enclosing a motor 104 and a motor-driven compressor 102. The outer casing of the housing 106 has an inlet opening 124 adapted for a communicable connection to a low-pressure gas source upstream of the compressor 102 and an outlet opening 126 adapted for a communicable connection to a means for creating a pressure reduction provided in the suction assembly leading to a compressor inlet 502. The means for creating a pressure reduction can be a converging nozzle disposed in the suction pipe, or a venturi, as previously described herein. In embodiments using the converging nozzle assembly, the nozzle has a nozzle outlet 500 adjacent at least one gap provided between the suction pipe 112 and the compressor inlet 502, the nozzle portion configured to accelerate flow of uncompressed gas across the gap(s) and into the compressor inlet 502 to create a pressure reduction at the gap(s) sufficient to draw refrigerant gas from the low-pressure refrigerant gas source upstream of the compressor 102 through the inlet opening 124, throughout the internal motor cavity of the housing 106, and into the gap(s) provided between the suction pipe 112 and the compressor inlet 502. Alternatively, the means for creating a pressure reduction can be a venturi 130 provided in the suction assembly, the venturi 130 having a gas return 134 provided in the narrow portion 132 of the venturi 130, the gas return communicably connecting the outlet opening 126 of the motor housing 106 to the narrow portion 132 of the venturi 130.

In another embodiment, the gas sweep motor cooling means described herein are provided for a centrifugal compressor that is driven directly by a high-speed motor (i.e. a direct drive assembly that does not require any gear train between the motor and the compressor) such as a high speed synchronous permanent magnet motor. This embodiment is particularly advantageous since, above a certain speed (about 15000 RPM), synchronous permanent magnet motors tend to become more cost effective than conventional induction motors. Another advantage is that synchronous permanent magnet motors have very low heat loss in the rotor, making the motor cooling system and methods particularly appropriate.

Figure 8:
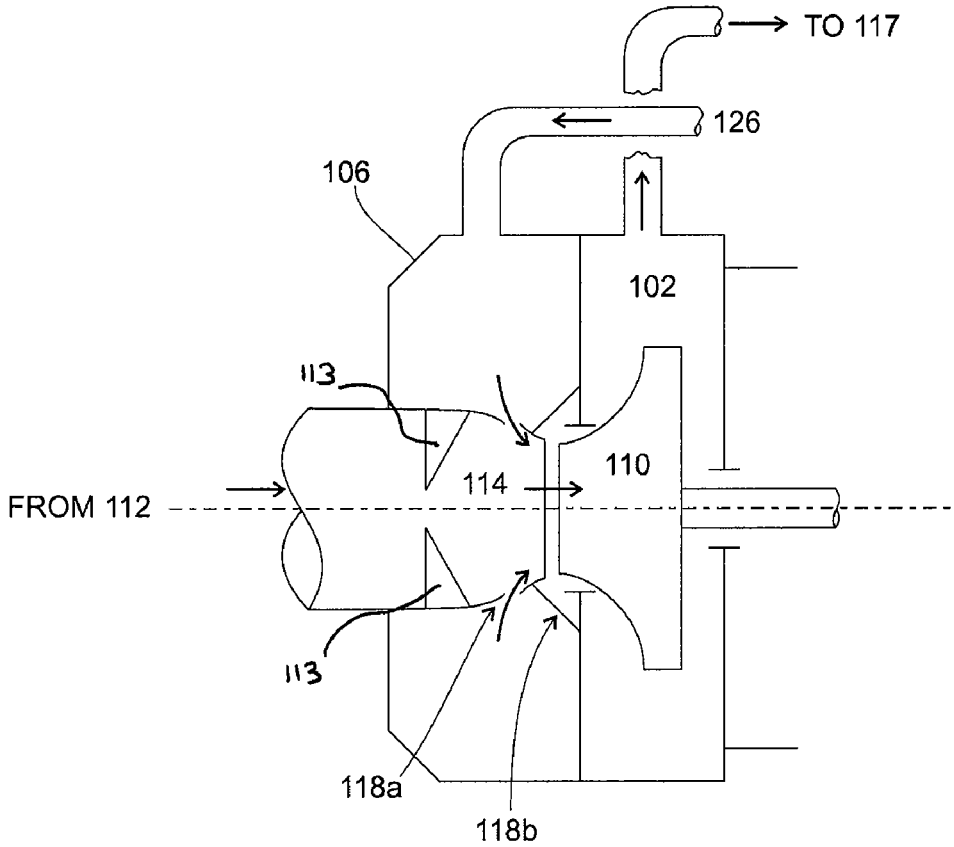
FIG. 8 illustrates schematically an embodiment of the motor cooling system as implemented with a centrifugal compressor.

FIG. 8 illustrates another particular embodiment of a gas intake assembly. In this particular embodiment, the annular gap 118 is at least partially obstructed or closed off by an annular wall 118*b*, thus impeding or preventing gas return through the annular gap 118. In this embodiment, some or all of the gas returning from the motor housing 106 is returned to the impeller 110 through at least one aperture 118*a* provided in the annular wall of the converging portion of nozzle 114. The aperture 118*a* is sized and positioned in the wall of the nozzle 114 so as to benefit from the pressure differential created by gas flowing through the intake manifold and being accelerated through the nozzle 114 to the impeller 110. Accordingly, one or more apertures 118*a* are configured and disposed so as to allow the gas returned from the motor housing 106 to enter the nozzle 114 and to merge smoothly with the main gas stream flowing from the intake manifold. As in other embodiments, the pressure differential generated by the nozzle 114 acts to draw gas from the evaporator 108, through the motor housing inlet 124, through the motor housing, out of the motor housing outlet 126, and eventually through the at least one aperture 118*a* into the nozzle 114. While this embodiment is illustrated in FIG. 8 as being implemented with a centrifugal compressor, it can also be implemented with non-centrifugal compressors.

Figure 9:
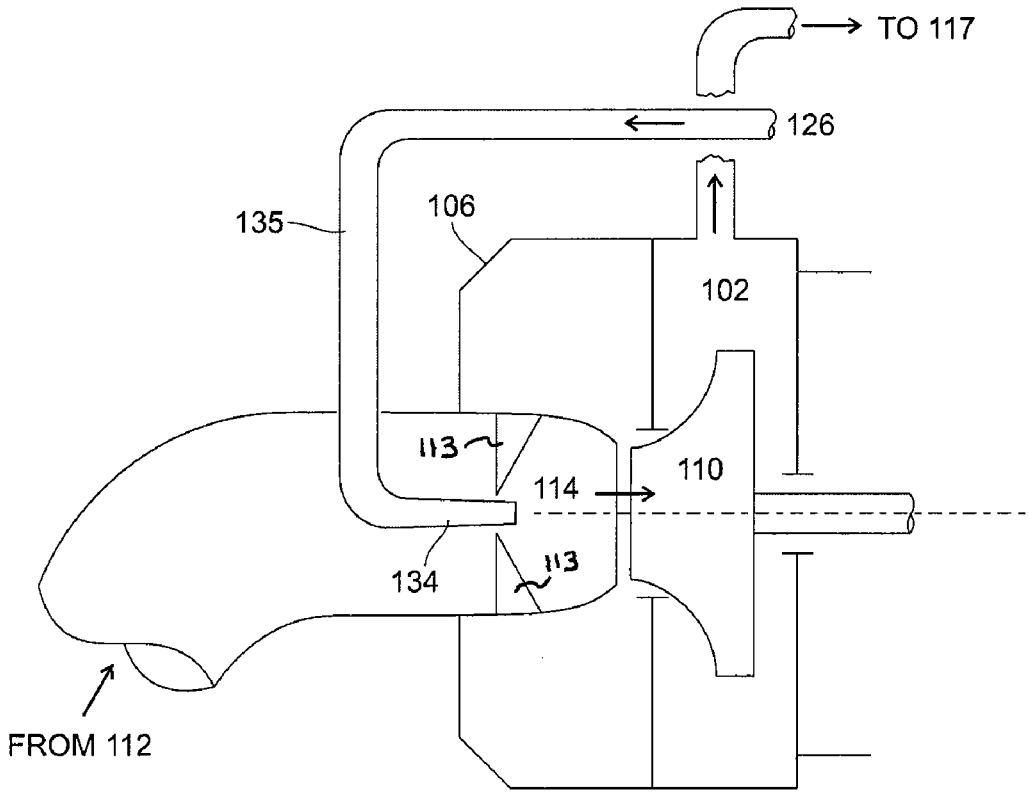
FIG. 9 illustrates schematically another embodiment of the motor cooling system as implemented with a centrifugal compressor.

FIG. 9 illustrates another particular embodiment of a gas intake assembly. In this particular embodiment, the gas return 134 is provided as an extension of the conduit 135 in fluid communication with to the motor housing outlet 126. In this embodiment, the gas returning from the motor housing 106 is returned through the conduit 135 of the gas return 134. In the example shown, the conduit 135 extends into the nozzle 114 to a discharge point in proximity to the radial center central longitudinal axis, so that the gas return 134 is situated at a discharge point within the axial flowpath of the nozzle 114. In the embodiment shown, the gas return 134 is located approximate the axial center of the nozzle 114, extending past flow control guide vanes 113 and into the converging portion of the nozzle 114. However, as can be appreciated, the location of the gas return can be selected so as to create a desired pressure differential to draw gas from the motor housing outlets 126, and thus may be offset from the axial center of the nozzle 114, and/or may be placed upstream, downstream, or anywhere within the nozzle 114 to produce a desired pressure differential and associated gas return flow from the motor housing outlet 126. While this embodiment is illustrated in FIG. 9 as being implemented with a centrifugal compressor, it can also be implemented with non-centrifugal compressors.

Furthermore, the features and embodiments illustrated and described regarding FIGS. 6-9 are all suitable for any compressor technology (centrifugal or others). This is true even though they happen to be represented as non-centrifugals on FIGS. 6-7, and centrifugals on FIGS. 8-9. By way of further explanation, the same principle applies in all those examples—the venturi of FIGS. 6-7 acts in a similar fashion to the combination of the converging nozzle 114 and inlet impeller of impeller 110. Furthermore, although the pressure is lowest at the venturi throat, there is also some significant depression even a small distance upstream or downstream of the throat. Therefore, in accordance with the example of FIG. 7, the annular slot or other feature provided for gas return does not need to be exactly at the throat, but can be shifted to on either side (upstream or downstream). In FIG. 8, the slot is shifted upstream. By way of further explanation, the gas return pipe 134 of FIG. 9, while shown as inserted into a converging-diverging nozzle assembly, could similarly be inserted into a venturi like the one of FIG. 6. Again, while the pipe 134 could be positioned at the throat of the venturi, it could also be shifted a bit upstream or downstream. For example, in FIG. 9, the terminal end of the pipe 134 is shifted upstream in order not to interfere with the impeller inlet.

While the invention has been described with reference to particular embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A gas compression system comprising:

a compressor having a compressing mechanism, an inlet and an outlet;

a motor connected to the compressor to drive the compressing mechanism;

a housing enclosing the compressor and the motor, the housing having a gas inlet and a gas outlet; and a suction assembly for receiving uncompressed gas from a gas source and conveying the uncompressed gas to the compressor, the suction assembly comprising:

a suction pipe in fluid communication with the gas source;

a nozzle having a nozzle inlet to receive the uncompressed gas from the suction pipe and a nozzle outlet to provide the uncompressed gas to the compressor inlet, the nozzle having a converging portion adjacent to the nozzle outlet, the nozzle converging portion further configured to receive uncompressed gas from the nozzle inlet and to accelerate flow of uncompressed gas from the nozzle inlet to the nozzle outlet, at least one annular gap disposed between the nozzle outlet and the compressor inlet, the at least one annular gap being in fluid communication with the housing gas outlet, and an annular wall adjacent to the annular gap, the annular wall impeding gas return from the motor housing through the annular gap;

the compressor inlet configured to receive uncompressed gas from the nozzle outlet and to provide the uncompressed gas to the compressor;

wherein a pressure side of the gas compression system includes an evaporator and extends to the suction assembly; and wherein the housing gas inlet is in fluid communication with the gas source on the low pressure side of the gas compression system and the housing gas outlet is in fluid communication with the nozzle through apertures in the converging portion of the nozzle, wherein the nozzle draws uncompressed gas from the gas source through the housing gas inlet into the housing to cool the motor, through the housing gas outlet and through said apertures in the converging portion of the nozzle to the compressor inlet.

2. The gas compression system of claim 1, wherein the compressor is a centrifugal compressor and the compressor inlet is comprised of an inlet eye to an impeller.

3. The gas compression system of claim 1, wherein the compressor is selected from the group consisting of reciprocating compressors, scroll compressors and screw compressors.

4. The gas compression system of claim 1, further comprising a condenser in communication with an expansion device, and the expansion device in communication with an evaporator, connected in a closed refrigerant loop with the compressor, wherein the uncompressed gas is uncompressed refrigerant gas, and wherein the gas source is the evaporator.

5. The gas compression system of claim 1, wherein the motor is a synchronous permanent magnet motor.

* * * * *